US010718297B2

(12) United States Patent
Yang

(10) Patent No.: US 10,718,297 B2
(45) Date of Patent: Jul. 21, 2020

(54) EXHAUST GAS RECIRCULATION COOLER

(71) Applicants: HYUNDAI MOTOR COMPANY, Seoul (KR); KIA MOTORS CORPORATION, Seoul (KR)

(72) Inventor: Il Suk Yang, Hwaseong-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 36 days.

(21) Appl. No.: 16/175,281

(22) Filed: Oct. 30, 2018

(65) Prior Publication Data

US 2020/0080522 A1 Mar. 12, 2020

(30) Foreign Application Priority Data

Sep. 6, 2018 (KR) ..... 10-2018-0106351

(51) Int. Cl.

| | |
|---|---|
| ***F02M 26/30*** | (2016.01) |
| ***F02M 26/32*** | (2016.01) |
| ***F01P 3/02*** | (2006.01) |
| ***F28D 9/00*** | (2006.01) |

(52) U.S. Cl.

CPC ..... *F02M 26/30* (2016.02); *F01P 3/02* (2013.01); *F02M 26/32* (2016.02); *F28D 9/0031* (2013.01); *F28D 9/0043* (2013.01); *F01P 2003/021* (2013.01)

(58) Field of Classification Search

None

See application file for complete search history.

(56) References Cited

U.S. PATENT DOCUMENTS

| | | | | |
|---|---|---|---|---|
| 6,360,702 | B1 * | 3/2002 | Osada | F28D 7/0066 123/196 AB |
| 9,732,708 | B2 * | 8/2017 | Neher | F02M 26/31 |
| 10,151,279 | B2 * | 12/2018 | Kim | F02M 26/24 |
| 10,495,036 | B2 * | 12/2019 | Kim | F02M 26/32 |
| 10,619,934 | B2 * | 4/2020 | Honnorat | F28D 9/0006 |
| 2016/0208745 | A1 * | 7/2016 | Neher | F28D 9/0043 |
| 2017/0138320 | A1 * | 5/2017 | Kim | F02M 26/30 |
| 2017/0204812 | A1 * | 7/2017 | Fernandez | F02M 26/29 |
| 2017/0218888 | A1 * | 8/2017 | Ohrem | F02M 26/31 |
| 2017/0276095 | A1 * | 9/2017 | Beyer | F02M 26/32 |
| 2017/0370329 | A1 * | 12/2017 | Chun | F28F 1/02 |
| 2019/0186432 | A1 * | 6/2019 | Kim | F28D 7/1684 |
| 2020/0102917 | A1 * | 4/2020 | Son | F02M 26/28 |

* cited by examiner

*Primary Examiner* — Kevin R Steckbauer

(74) *Attorney, Agent, or Firm* — Morgan, Lewis & Bockius LLP

(57) ABSTRACT

An exhaust gas recirculation (EGR) cooler includes: a cylinder block having a mounting space and having a cooling water inlet through which cooling water is introduced; at least one core assembly disposed in the mounting space and including an upper core and a lower core, wherein the upper core and the lower core are coupled to each other to have a flow path through which the exhaust gas flows; and a cover plate blocking the mounting space and having a cover inlet through which the exhaust gas flows in; a cover outlet through which the exhaust gas flows out; and a cooling water outlet through which the cooling water is discharged.

8 Claims, 6 Drawing Sheets

EXHAUST GAS RECIRCULATION COOLER

CROSS-REFERENCE TO RELATED APPLICATION

This application claims priority to and the benefit of Korean Patent Application No. 10-2018-0106351 filed in the Korean Intellectual Property Office on Sep. 6, 2018, the entire contents of which are incorporated herein by reference.

TECHNICAL FIELD

The present disclosure relates to an exhaust gas recirculation (EGR) cooler, and more particularly, to an EGR cooler installed at a cylinder block.

BACKGROUND

Nitrogen oxides (NOx) contained in exhaust gas emitted from vehicles are restricted as primary air pollutants, and therefore, various researches has been conducted to reduce emission of NOx.

As one method to reduce such harmful exhaust gases, a vehicle is equipped with an exhaust gas recirculation (EGR) system. Generally, NOx is increased when the amount of air in an EGR mixer is high and combustion is good. Therefore, the EGR system mixes a portion (for example, 5% to 20%) of exhaust gas discharged from an engine back into the mixer to dilute the amount of oxygen in the mixer and obstruct combustion, thereby suppressing the occurrence of NOx.

Further the EGR system can improve fuel efficiency. For example, in general, pumping loss is reduced in a low speed/low load region and ignition timing based on a decrease in temperature of a combustion chamber is advanced in a medium/medium load region through the EGR system, and thus, fuel efficiency of a vehicle can be improved.

One example of the EGR system includes a low pressure exhaust gas recirculation (LP-EGR) device. The LP-EGR device recirculates exhaust gas that has passed through a turbine of a turbocharger to an intake passage at a front stage of a compressor.

In addition, the EGR system generally includes a cooler, Such that recirculated exhaust gas is cooled by the cooler and supplied to a combustion chamber.

The conventional EGR cooler includes a cooling structure installed inside a separate housing, and requires various components such as a nipple or the like for connecting a recirculation line through which a recirculating gas flows outside of the housing, and incurs an increased manufacturing cost of a vehicle due to an increase in a length of the recirculation line.

Further, since it is difficult to firmly fix the EGR cooler inside the vehicle, the EGR cooler housing wobbles while the vehicle is moving, causing excessive vibration.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide an exhaust gas recirculation (EGR) cooler having advantages of reducing manufacturing cost of a vehicle.

The present disclosure has also been made in an effort to provide an EGR cooler having advantages of reducing vibration caused as a vehicle is driven.

An exemplary embodiment of the present disclosure provides an exhaust gas recirculation (EGR) cooler including: a cylinder block having a mounting space and having a cooling water inlet through which cooling water flows in; at least one core assembly disposed in the mounting space and including an upper core having an upper core inlet through which exhaust gas flows in and an upper core outlet through which exhaust gas flows out and a lower core having a lower core inlet through which exhaust gas flows in and a lower core outlet through which exhaust gas flows out, the upper core and the lower core being coupled to have a flow path through which exhaust gas flows; and a cover plate blocking the mounting space and having a cover inlet through which the exhaust gas flows in, a cover outlet through which the exhaust gas flows out, and a cooling water outlet through which the cooling water is discharged.

A plurality of core assemblies may be sequentially stacked in the mounting space, and cooling water flow paths through which the cooling water flows may be formed between an inner surface of the mounting space and a corresponding core assembly, between the plurality of core assemblies, and between the cover plate and a corresponding core assembly.

The EGR cooler may further include a gasket provided between an upper surface of the cylinder block and the cover plate.

An inner fin may be provided on an inner surface of the upper core or the lower core.

An outer fin may be provided on an outer surface of the upper core or the lower core The plurality of core assemblies may be sequentially mounted in the mounting space, a lower core inlet of any one of the core assemblies and an upper core inlet of another core assembly adjacent to the one core assembly may be tightly attached to communicate with each other, and an upper core outlet of the one core assembly and a lower core outlet of the other core assembly adjacent to the one core assembly may be tightly attached to communicate with each other.

The cover inlet of the cover plate may include an inlet bracket guiding the exhaust gas introduced to the exhaust gas flow path inside the core assembly, the inlet bracket may have a shape of which a lower surface is open, a through hole through which the exhaust gas flows in may be provided on an upper surface of the inlet bracket, and the upper surface of the inlet bracket may be sloped at a predetermined angle toward the exhaust gas flow path formed at the core.

The cover outlet of the cover plate may further include an outlet bracket guiding the exhaust gas flowing out from the exhaust gas flow path inside the core assembly, and the outlet bracket has a cylindrical shape of which an upper surface and a lower surface are open.

A rib bent in a direction opposite to the cylinder block may be formed at an outer portion of the cover plate.

An upper inlet flange protruding to the outside of the core assembly may be formed around the upper core inlet, an upper outlet flange protruding to the outside of the core assembly may be formed around the upper core outlet, a lower inlet flange protruding to the outside of the core assembly may be formed around the lower core inlet, and a lower outlet flange protruding to the outside of the core assembly may be formed around the lower core outlet.

The upper inlet flange formed at any one of the core assemblies may be tightly attached to the lower inlet flange formed at the other core assembly adjacent to the one core assembly, and the upper outlet flange formed at the one core assembly may be tightly attached to the lower outlet flange formed at the other core assembly adjacent to the one core assembly to form the cooling water flow path through which cooling water flows between the one core assembly and the other core assembly adjacent thereto.

According to the exemplary embodiment of the present disclosure, since the EGR cooler has the cooling structure for heat-exchanging between cooling water and exhaust gas inside the cylinder block, the configuration of the EGR cooler may be simplified, and thus manufacturing cost of a vehicle may be reduced.

In addition, since the EGR cooler is formed in the cylinder block, generation of vibrations due to wobbling of the EGR cooler may be prevented when a vehicle is driving.

BRIEF DESCRIPTION OF THE DRAWINGS

The drawings are to be used for describing exemplary embodiments of the present disclosure, so a technical concept of the present disclosure should not be meant to restrict the invention to the accompanying drawings.

DETAILED DESCRIPTION

Figure 1:
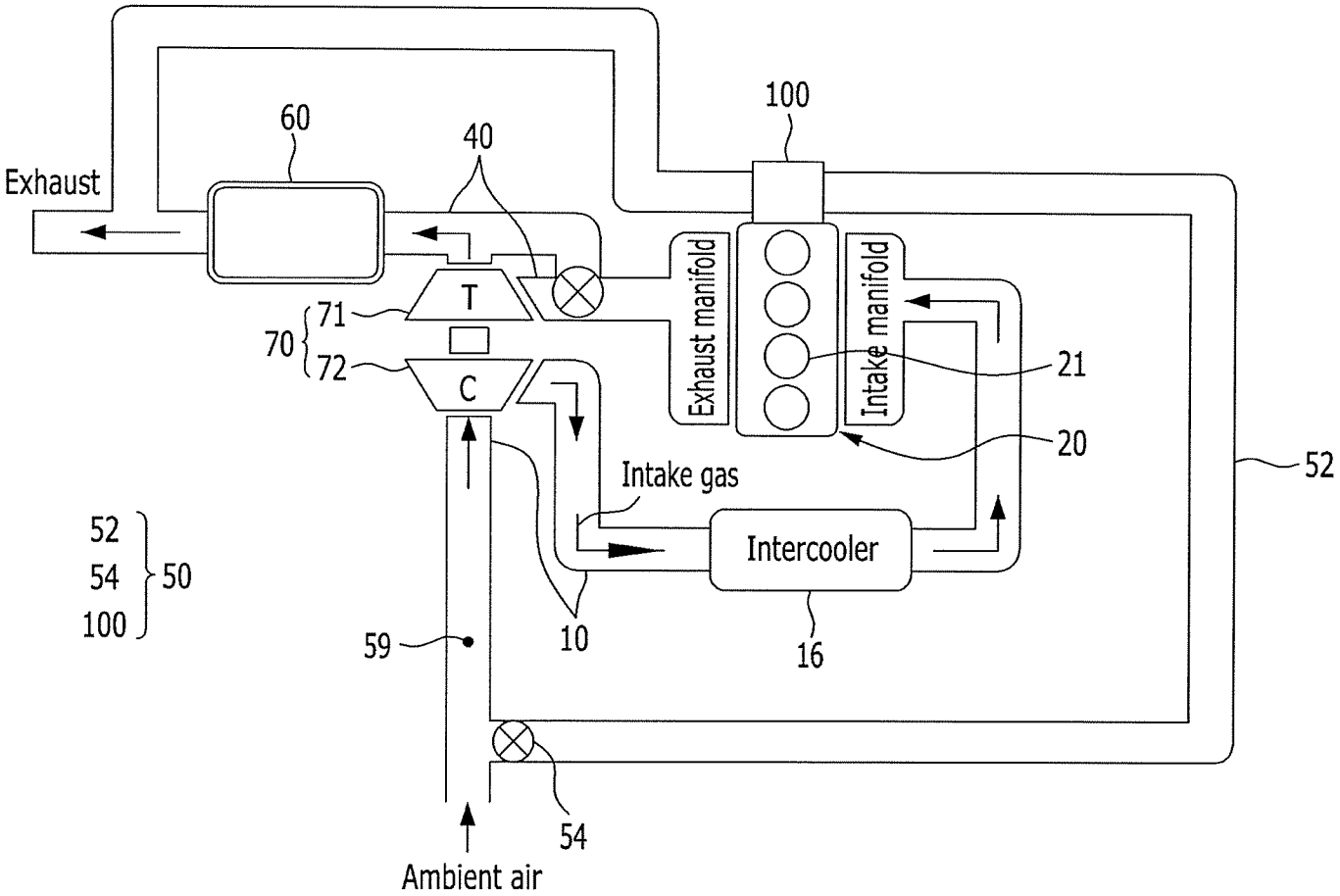
FIG. 1 is a view illustrating a configuration of an engine system to which an exhaust gas recirculation (EGR) cooler according to an exemplary embodiment of the present disclosure is applied.

The present disclosure will be described more fully hereinafter with reference to the accompanying drawings, in which exemplary embodiments of the invention are shown. As those skilled in the art would realize, the described exemplary embodiments may be modified in various different ways, all without departing from the spirit or scope of the present disclosure.

In order to clarify the present disclosure, parts that are not related to the description will be omitted, and similar reference numerals are used for the similar parts throughout the specification.

The size and thickness of each element are arbitrarily illustrated in the drawings, and the present disclosure is not necessarily limited thereto. In the drawings, the thickness of layers, films, panels, regions, etc., are exaggerated for clarity.

First, an engine system to which an exhaust gas recirculation (EGR) cooler according to an exemplary embodiment of the present disclosure is applied will be described with reference to FIG. 1.

FIG. 1 is a view illustrating a configuration of an engine system to which an exhaust gas recirculation (EGR) cooler according to an exemplary embodiment of the present disclosure is applied.

As illustrated in FIG. 1, the engine system to which an EGR cooler 100 according to an exemplary embodiment of the present disclosure is applied may include an engine 20 and an EGR device 50.

The engine 20 includes a plurality of combustion chambers 21 for generating power necessary for driving of a vehicle by combustion of a fuel, and the engine 20 is connected to an intake line 10 through which intake gas supplied to the combustion chambers 21 flows and an exhaust line 40 through which an exhaust gas discharged from the combustion chambers 21 flows.

The exhaust line 40 is provided with an exhaust gas purifying device 60 for purifying various harmful substances contained in the exhaust gas discharged from the combustion chambers 21. The exhaust gas purifying device 60 may include a lean NOx trap (LNT) for purifying nitrogen oxides, a diesel oxidation catalyst, and a diesel particulate filter.

The engine system of the present disclosure may further include a turbocharger 70 for compressing intake air supplied to the combustion chambers 21.

The turbocharger 70 compresses intake gas (ambient air+recirculation gas) flowing through the intake line 10, and supplies the compressed intake gas to the combustion chambers 21. The turbocharger 70 includes a turbine 71 provided in the exhaust line 40 and rotated by the exhaust gas discharged from the combustion chambers 21, and a compressor 72 cooperatively rotated with the turbine 71 and compressing the intake gas.

The exhaust gas recirculation apparatus 50 includes a recirculation line 52, an EGR cooler 100, and an EGR valve 54.

The recirculation line 52 is branched from the exhaust line 40 downstream of the turbine 71, and joins the intake line 10 upstream of the compressor 72. The EGR cooler 100 is disposed at the EGR line and cools the exhaust gas flowing through the recirculation line 52. The EGR valve 54 is disposed at a position where the EGR line and the intake line 10 join, and regulates the amount of a recirculation gas flowing to the intake line 10. Here, the exhaust gas supplied to the intake line 10 through the recirculation line 52 is called a recirculation gas.

As the exhaust gas recirculation apparatus 50, a low pressure exhaust gas recirculation apparatus will be described as an example. However, the present disclosure is not limited thereto, and may also be applied to a high pressure exhaust gas recirculation apparatus.

Hereinafter, an EGR cooler according to an exemplary embodiment of the present disclosure will be described in detail with reference to the accompanying drawings.

Figure 2:
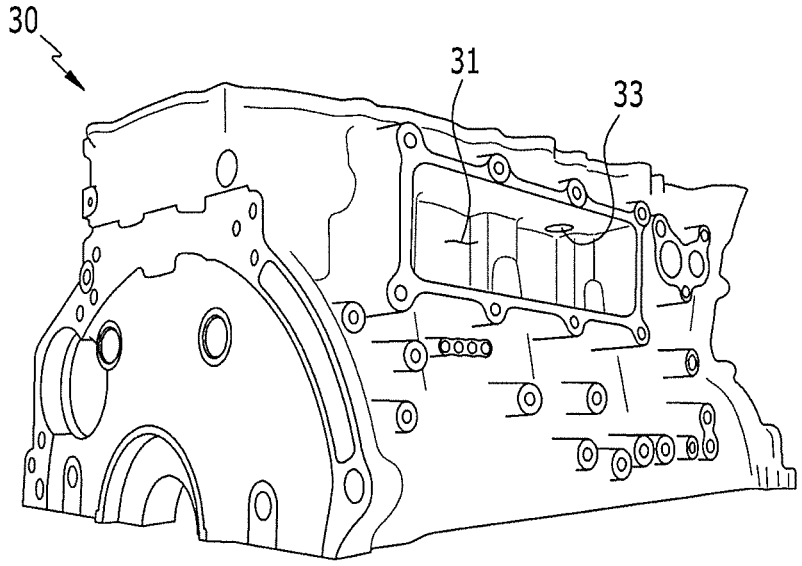
FIG. 2 is a partial perspective view illustrating a configuration of a cylinder block according to an exemplary embodiment of the present disclosure.
Figure 3:
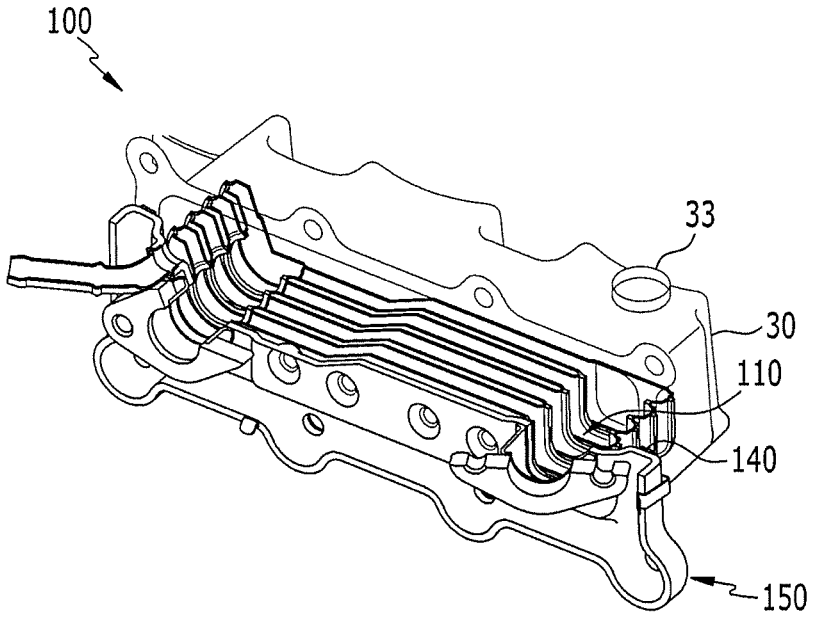
FIG. 3 is a partially cut perspective view illustrating an EGR cooler according to an exemplary embodiment of the present disclosure.

The EGR cooler 100 according to an exemplary embodiment of the present disclosure includes a cylinder block 30, a plurality of core assemblies 110 installed in a mounting space 31 of the cylinder block 30, and a cover plate 150 covering the mounting space 31 in which the core assemblies 110 are installed (see FIGS. 2 and 3).

FIG. 2 is a partial perspective view illustrating a configuration of the cylinder block 30 according to an exemplary embodiment of the present disclosure.

As illustrated in FIG. 2, the plurality of combustion chambers 21 are formed in the cylinder block 30, and the mounting space 31 is formed on the outer side thereof. A cooling water inlet 33 through which cooling water (or coolant) which has cooled the cylinder block 30 flows in is provided on an inner surface of the mounting space 31.

Figure 4:
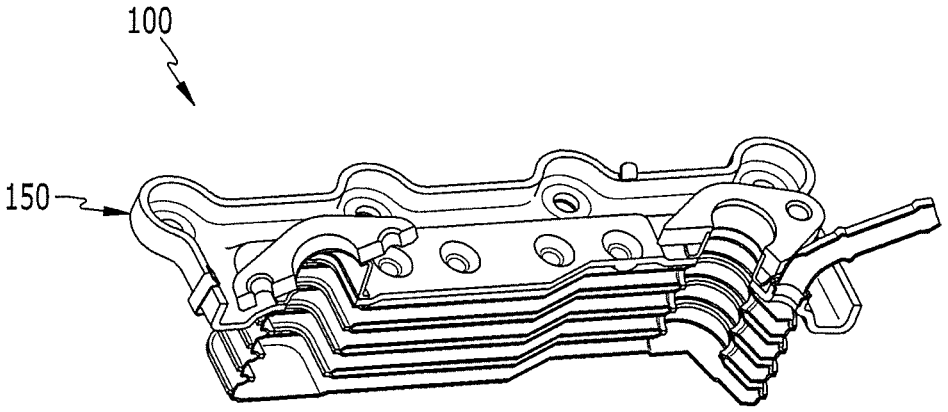
FIG. 4 is a perspective view illustrating a plurality of cores and a cover plate according to an exemplary embodiment of the present disclosure.

FIG. 3 is a partially cut perspective view illustrating an EGR cooler according to an exemplary embodiment of the present disclosure. FIG. 4 is a perspective view illustrating a plurality of cores and a cover plate according to an exemplary embodiment of the present disclosure.

As illustrated in FIGS. 3 and 4, the plurality of core assemblies 110 are stacked in the mounting space 31, and the mounting space 31 is closed by the cover plate 150.

The core assembly 110 includes an upper core 120 and a lower core 130 to form a space allowing a recirculation gas introduced through a recirculation line 52 to flow therein. The cover plate 150 is installed on the top of the plurality of core assemblies 110 stacked in the mounting space 31 to close the mounting space 31.

Cooling water flow paths through which the cooling water introduced through the cooling water inlet 33 flows are formed between the plurality of core assemblies 110. That is, the cooling water flow paths may be formed between an inner surface of the mounting space 31 and a corresponding core assembly 110, between adjacent core assemblies 110, and between the cover plate 150 and a corresponding core assembly 110.

A gasket 140 is installed on an upper surface of the cover plate 150 and the cylinder block 30 to seal the mounting space 31 of the cylinder block 30 from the outside.

Figure 5:
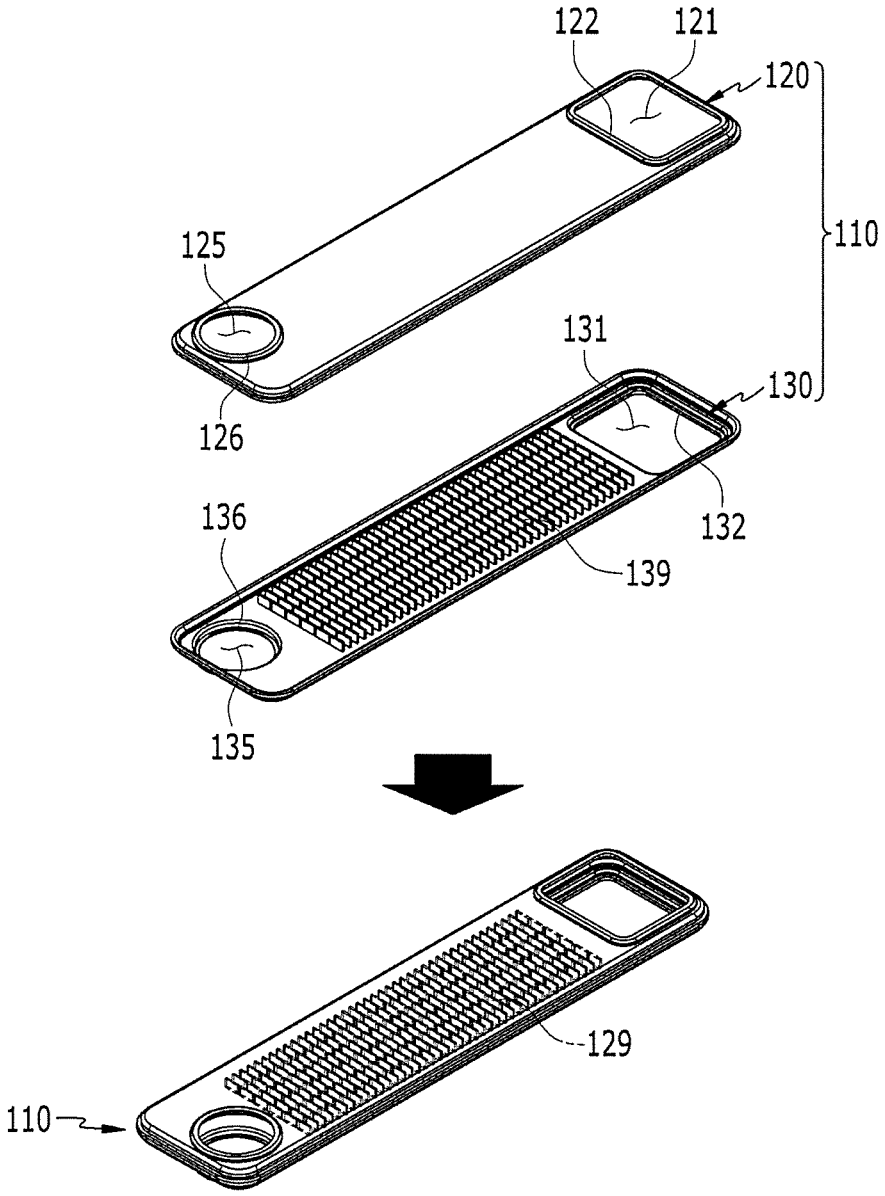
FIG. 5 is a view illustrating a configuration of a core according to an exemplary embodiment of the present disclosure.

FIG. 5 is a view illustrating a configuration of a core according to an exemplary embodiment of the present disclosure.

As illustrated in FIG. 5, the upper core 120 and the lower core 130 have a substantially rectangular shape, and the upper core 120 includes an upper core inlet 121 through which an exhaust gas flows in and an upper core outlet 125 through which the exhaust gas is discharged, and the lower core 130 includes a lower core inlet 131 through which the exhaust gas flows in and a lower core outlet 135 through which the exhaust gas is discharged. The upper core inlet 121 and the lower core inlet 131 may have a quadrangular shape and the upper core outlet 125 and the lower core outlet 135 may have a circular shape.

Since the upper core inlet 121 and the lower core inlet 131 have a quadrangular shape, an inflow amount of the recirculation gas may be maximized to minimize flow resistance occurring when the recirculation gas flows in.

The upper core inlet 121 and the upper core outlet 125 are formed at respective ends of the upper core 120, and the lower core inlet 131 and the lower core outlet 135 are formed at respective ends of the lower core 130.

An upper inlet flange 122 protruding to the outside of the core is formed around the upper core inlet 121, and an upper outlet flange 126 protruding to the outside of the core is formed around the upper core outlet 125. A lower inlet flange 132 protruding to the outside of the core is formed around the lower core inlet 131, and a lower outlet flange 136 protruding to the outside of the core is formed around the lower core outlet 135.

When the two adjacent core assemblies 110 are coupled, the upper inlet flange 122 formed at the upper core 120 of the lower core assembly 110 is tightly attached and coupled to the lower inlet flange 132 formed at the lower core 130 of the upper core assembly 110, and the upper outlet flange 126 formed at the upper core 120 of the lower core assembly 110 is tightly attached and coupled to the lower outlet flange 136 formed at the lower core 130, whereby a cooling water flow path allowing cooling water to flow therethrough is formed between the two adjacent core assemblies 110.

The upper core 120 and the lower core 130 are coupled to form a flow path through which the exhaust gas flows.

An inner fin 139 may be provided at an inner surface of the upper core 120 and/or the lower core 130, and an outer fin 129 may be provided at an outer surface of the upper core 120 and/or the lower core 130. The inner fin 139 and the outer fin 129 may be integrally formed with the upper core 120 and/or the lower core 130, or a separate inner fin 139 and outer fin 129 may be coupled to the upper core 120 and/or the lower core 130 through a method such as welding or the like. Since the inner fin 139 and/or the outer fin 129 are formed at the upper core 120 and/or the lower core 130, a heat dissipating area may be increased to increase cooling efficiency and rigidity of the upper core 120, and the lower core 130 may be reinforced to strengthen pressure resistance characteristics.

The lower core 130 of the lowermost core assembly 110 (in other words, the core assembly 110 provided on the opposite side of the cover plate 150) installed at the mounting space 31 may not have the lower core inlet 131 and the lower core outlet 135.

Figure 6:
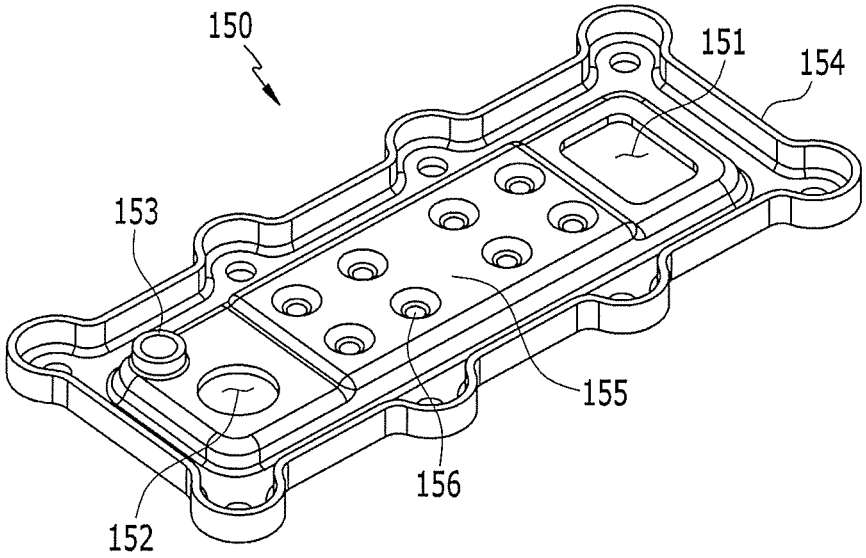
FIG. 6 is a view illustrating a configuration of a cover plate according to an exemplary embodiment of the present disclosure.

FIG. 6 is a view illustrating a configuration of a cover plate according to an exemplary embodiment of the present disclosure.

As illustrated in FIG. 6, the cover plate 150 has a substantially rectangular plate shape, and the cover plate 150 includes a cover inlet 151 through which the exhaust gas flows in, a cover outlet 152 through which the exhaust gas flows out, and a cooling water outlet 153 through which the cooling water is discharged.

The cover inlet 151 communicates with the exhaust gas inlet formed at the upper core 120 of the core assembly 110 installed on the uppermost side of the mounting space 31, and the cover outlet 152 communicates with an exhaust gas outlet formed at the upper core 120 of the core assembly 110 installed on the uppermost side of the mounting space 31. The cooling water outlet 153 communicates with a cooling water flow path formed in the mounting space 31.

A rib 154 bent in a direction opposite to the cylinder block 30 is formed at an outer portion of the cover plate 150 to reinforce rigidity of the cover plate 150.

A step portion 155 protruding to the opposite side of the mounting space 31 is formed at the center of the cover plate 150 to form a space between the core and the cover plate 150. The space formed between the core assembly 110 and the cover plate 150 serves as a cooling water flow path through which the cooling water flows.

A plurality of protrusions 156 protruding to the inside of the mounting space 31 are provided in the cover plate 150. The protrusions 156 may have a hemispherical shape. The protrusions 156 hamper flow of the cooling water flowing through the cooling water flow path formed between the cover plate 150 and the core assembly 110, increasing heat dissipation efficiency of the cooling water flowing through the cooling water flow path. In addition, the cooling water flowing through the cooling water flow path is reduced in flow rate by virtue of the protrusions 156, reducing noise due to the cooling water.

Figure 7:
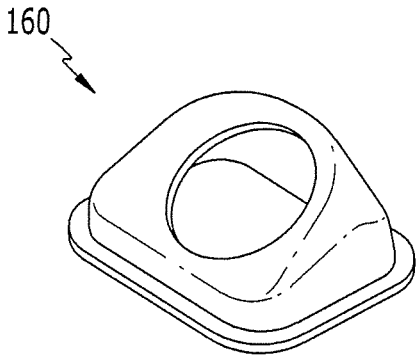
FIG. 7 is a view illustrating a configuration of an inlet bracket according to an exemplary embodiment of the present disclosure.

FIG. 7 is a view illustrating a configuration of an inlet bracket according to an exemplary embodiment of the present disclosure.

As illustrated in FIG. 7, an inlet bracket 160 is provided at the cover inlet 151 to guide the exhaust gas to the exhaust gas flow path inside the core. The recirculation line 52 is connected to the inlet bracket 160.

The inlet bracket 160 has a shape of which a lower surface is open. That is, the lower portion of the inlet bracket 160 has a shape corresponding to the upper core inlet 121 and the lower core inlet 131 of the core assembly 110.

A through hole through which the exhaust gas flows in is formed on an upper surface of the inlet bracket 160. Here, the upper surface of the inlet bracket 160 is formed to be sloped at a predetermined angle toward the exhaust gas flow path formed inside the core assembly 110. Since the upper surface of the inlet bracket 160 is sloped at the predetermined angle in this manner, the exhaust gas introduced through the inlet bracket 160 may easily flow into the exhaust gas flow path of the core assembly 110.

Figure 8:
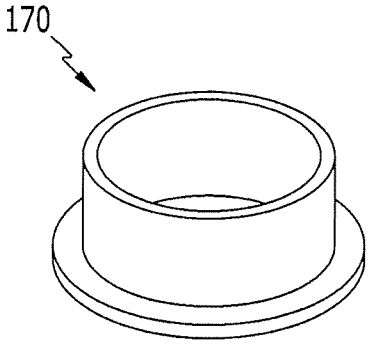
FIG. 8 is a view illustrating a configuration of an outlet bracket according to an exemplary embodiment of the present disclosure.

FIG. 8 is a view illustrating a configuration of an outlet bracket 170 according to an exemplary embodiment of the present disclosure.

As illustrated in FIG. 8, the outlet bracket 170 is provided at the cover outlet 152 to guide the exhaust gas flowing out from the exhaust gas flow path inside the core assembly 110 to flow out. The recirculation line 52 is connected to the outlet bracket 170.

The outlet bracket 170 has a cylindrical shape of which an upper surface and a lower surface are open. That is, a lower portion of the outlet bracket 170 has a shape corresponding to a shape of the upper core outlet 125 and the lower core outlet 135 of the core assembly 110.

Hereinafter, the operation of the EGR cooler according to an exemplary embodiment of the present disclosure as described above will be described in detail.

The exhaust gas flowing through the recirculation line 52 flows into the exhaust gas flow path of the core assembly 110 through the inlet bracket 160 of the cover plate 150 and the cover inlet 151 of the cover plate 150. Since the upper core inlet 121 and the lower core inlet 131 each have a rectangular shape, loss of pressure caused by the exhaust gas at the core inlet and the lower core inlet 131 is minimized. In addition, the exhaust gas may be evenly introduced to the exhaust gas flow paths of the plurality of cores which are stacked vertically. Since the upper surface of the inlet bracket 160 is sloped at the predetermined angle in a direction toward the exhaust gas flow path of the core assembly 110, an inlet path of the exhaust gas configured by the inlet bracket 160 and the exhaust gas flow path of the core assembly 110 may be formed to be gentle, and thus the exhaust gas may be smoothly introduced from the inlet bracket 160 to the exhaust gas flow path of the core assembly 110.

At the same time, a portion of the cooling water which has circulated through a water jacket (not shown) of the cylinder block 30 is introduced to the mounting space 31 through the cooling water inlet 33 formed at the cylinder block 30.

The exhaust gas flowing through the exhaust gas flow passage in the core assembly 110 is exchanged with the cooling water introduced to the cooling water flow path inside the mounting space 31, and thus a temperature of the exhaust gas is lowered. Here, a heat dissipating area is increased by the inner and outer fins 139 and 129 formed at each of the core assemblies 110, thereby improving heat exchange performance between the exhaust gas and the cooling water.

The exhaust gas having the temperature lowered by heat exchange is discharged to the lower core outlet 135 and the upper core outlet 125 of each of the core assemblies 110, and is discharged to the recirculation line 52 downstream of the EGR cooler 100 through the outlet bracket 170 provided at the cover plate 150.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. An exhaust gas recirculation (EGR) cooler comprising:

a cylinder block having a mounting space and having a cooling water inlet through which cooling water is introduced;

at least one core assembly disposed in the mounting space, the at least one core assembly including:

an upper core having an upper core inlet through which exhaust gas flows in and an upper core outlet through which the exhaust gas flows out; and a lower core having a lower core inlet through which the exhaust gas flows in and a lower core outlet through which the exhaust gas flows out, wherein the upper core and the lower core are coupled to each other to have a flow path through which the exhaust gas flows; and a cover plate blocking the mounting space, the cover plate having:

a cover inlet through which the exhaust gas flows in;

a cover outlet through which the exhaust gas flows out; and a cooling water outlet through which the cooling water is discharged, wherein:

a plurality of core assemblies are sequentially stacked in the mounting space, the cooling water flows through cooling water flow paths between an inner surface of the mounting space and a core assembly that is adjacent the inner surface of the mounting space among the plurality of core assemblies, between the plurality of core assemblies, and between the cover plate and another core assembly that is adjacent the cover plate among the plurality of core assemblies, respectively, in the plurality of core assemblies, a lower core inlet of any one of the core assemblies and an upper core inlet of another core assembly adjacent to the one core assembly are tightly attached to communicate with each other, an upper core outlet of the one core assembly and a lower core outlet of the other core assembly adjacent to the one core assembly are tightly attached to communicate with each other, the upper core inlet has an upper inlet flange protruding toward an outer side of each of the plurality of core assemblies around the upper core inlet, the upper core outlet has an upper outlet flange protruding toward the outer side of each of the plurality of core assemblies around the upper core outlet, the lower core inlet has a lower inlet flange protruding toward the outer side of each of the plurality of core assemblies around the lower core inlet, and the lower core outlet has a lower outlet flange protruding toward the outer side of each of the plurality of core assemblies around the lower core outlet.

2. The EGR cooler of claim 1, further comprising a gasket disposed between an upper surface of the cylinder block and the cover plate.

3. The EGR cooler of claim 1, wherein an inner fin is disposed on an inner surface of the upper core or the lower core.

4. The EGR cooler of claim 1, wherein an outer fin is disposed on an outer surface of the upper core or the lower core.

5. The EGR cooler of claim 1, wherein the cover inlet of the cover plate includes an inlet bracket guiding the exhaust gas introduced to the exhaust gas flow path inside the at least one core assembly, wherein the inlet bracket has a shape of which a lower surface is open, and includes a through hole through which the exhaust gas flows in at an upper surface of the inlet bracket, and wherein the upper surface of the inlet bracket is slanted downwardly with respect to the lower surface of the inlet bracket at a predetermined angle toward the exhaust gas flow path.

6. The EGR cooler of claim 1, wherein the cover outlet of the cover plate includes an outlet bracket guiding the exhaust gas flowing out from the exhaust gas flow path inside the at least one core assembly, and the outlet bracket has a cylindrical shape of which an upper surface and a lower surface are open.

7. The EGR cooler of claim 1, wherein the cover plate has a rib bent in a direction opposite to the cylinder block at an outer portion of the cover plate.

8. The EGR cooler of claim 1, wherein the upper inlet flange of any one of the core assemblies is tightly attached to the lower inlet flange of another core assembly adjacent to the one core assembly, and the upper outlet flange of the one core assembly is tightly attached to the lower outlet flange of the other core assembly adjacent to the one core assembly, such that the cooling water flows between the one core assembly and the other core assembly adjacent thereto as a cooling water flow path.

* * * * *